United States Patent [19]
Spencer et al.
[11] Patent Number: 4,470,649
[45] Date of Patent: Sep. 11, 1984

[54] LOW PROFILE INTEGRATED CIRCUIT ELECTRICAL SOCKET ASSEMBLY

[75] Inventors: James R. Spencer, Woburn; Robert E. Smith, Arlington, both of Mass.

[73] Assignee: Midland-Ross Corporation, Cleveland, Ohio

[21] Appl. No.: 391,001

[22] Filed: Jun. 23, 1982

[51] Int. Cl.³ ..... H01R 13/187
[52] U.S. Cl. ..... 339/17 C; 29/844; 339/220 R; 339/258 R
[58] Field of Search ..... 339/17 R, 17 C, 220 R, 339/220 T, 256 R, 258 R, 258 P, 258 F, 262 R; 29/844, 845

[56] References Cited

U.S. PATENT DOCUMENTS

| | | | |
|---|---|---|---|
| 2,816,275 | 12/1957 | Hammell | 339/220 R |
| 2,856,593 | 10/1958 | Gookin | 339/220 R |
| 2,969,517 | 1/1961 | Gluck | 339/258 R |
| 3,120,989 | 2/1964 | Solorow | 339/256 R |
| 3,681,744 | 8/1972 | Olsson | 339/17 C |
| 3,704,441 | 11/1972 | Douglass | 339/220 R |
| 4,186,990 | 2/1980 | Bertoglio | 339/262 R |

FOREIGN PATENT DOCUMENTS

| | | | |
|---|---|---|---|
| 2621309 | 12/1977 | Fed. Rep. of Germany | 339/258 R |
| 1185679 | 3/1970 | United Kingdom | 339/220 R |

*Primary Examiner*—Neil Abrams
*Attorney, Agent, or Firm*—H. Duane Switzer

[57] ABSTRACT

The low profile integrated circuit electrical socket assembly includes a drawn metallic socket (A) into which a leaf spring insert (B) is press fit. The socket includes a hollow upper body portion (10), a hollow lower body portion (12), a transition portion (14) interconnecting the upper and lower body portions, and a radial flange (16) at the inlet end of the upper body portion. A lead receiving passage (18) is defined longitudinally through the upper body portion and into the lower body portion. The socket is inserted through an aperture (60) of a dielectric board (C) with the flange abutting one board surface (62) and the transition portion disposed outwardly adjacent the opposite surface (64). An axially compressive force is applied between the flange and the transition portion in such a manner that the transition portion is deformed radially outward into a retaining collar. In this manner, the flange and collar hold the socket securely in the dielectric board. Leads (72) of an electric component (D) extend into the axial lead receiving passage in electrical and frictional engagement with the socket and leaf spring insert.

6 Claims, 5 Drawing Figures

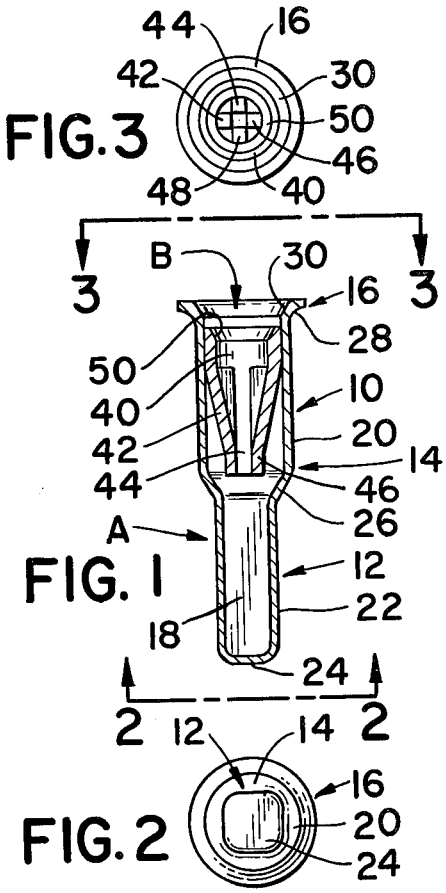
FIG. 3
FIG. 1
FIG. 2
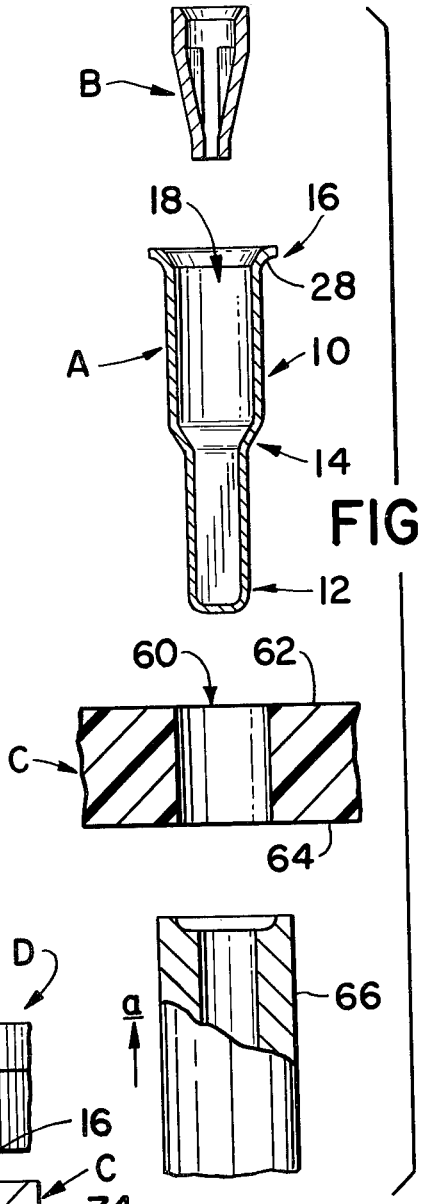
FIG. 4
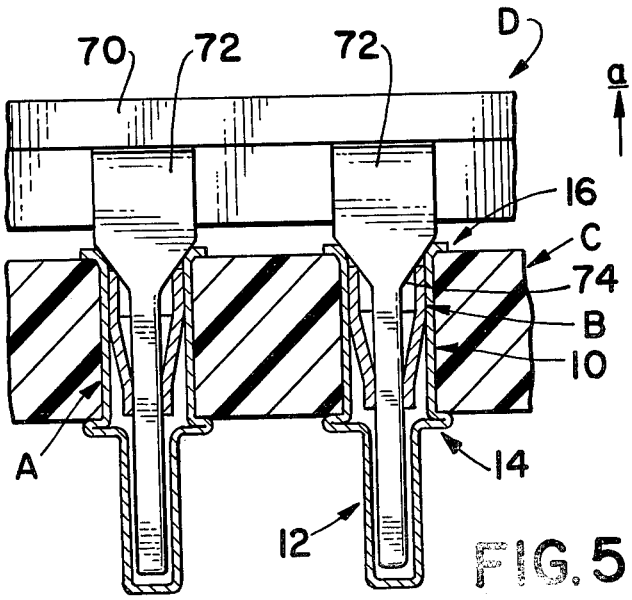
FIG. 5

LOW PROFILE INTEGRATED CIRCUIT ELECTRICAL SOCKET ASSEMBLY

BACKGROUND OF THE INVENTION

This invention pertains to the art of electrical sockets and, more particularly, to sockets which are mounted in dielectric boards for receiving leads. The invention finds specific application in sockets for receiving integrated circuit leads and will be described with particular reference thereto. It will be appreciated, however, that the invention has other applications and may be used, for example, for receiving electrical wires, leads from transistors, electro-mechanical relays, capacitors, and other electrical components. The sockets themselves are adapted to be received in other sockets to function as integrated circuit carriers or to be hard wired.

Conventionally, integrated circuit lead sockets include a generally tubular portion for receiving each lead. The tubular portion defines an interior bore which is approximately 10 to 20 millimeters in length and has an interior diameter of approximately 0.75 to 1.5 millimeters. To improve electrical contact between the socket and the leads, an insert which includes a plurality of inwardly biased spring leaves is frictionally inserted into the interior bore. A solid wrapping post, having a generally square cross-section and a length of approximately 10 to 20 millimeters, extends axially from the tubular portion to facilitate electrical interconnection with associated circuitry.

Heretofore, some integrated circuit lead sockets have been manufactured by stamping and other conventional forming techniques. However, quality control of stamped sockets is very difficult. Often, the sockets are out of round or have unplated areas. These defects reduce the integrity of electrical interconnection with the leads, increase the potential for corrosion, and increase the likelihood of failure.

To obtain an acceptable level of reliability, lead sockets are almost universally machined. A single piece of metal is machined around its periphery to form the appropriate grooves, camming surfaces, and other peripheral features for connecting the socket with the dielectric board material. An upper part of the socket is bored axially from one end to form the lead receiving opening and a solid, generally square wrapping post is machined at the other end. Commonly, the bore is flared adjacent the open end and a leaf spring type insert is press fit thereinto for frictional retention of a lead. The sockets are typically mounted in a dielectric board material by force fit relationships between an external peripheral groove in each socket and the side wall of the associated opening in the board material. As will be readily appreciated, precise boring and machining of these small parts is relatively difficult and labor intensive.

The present invention provides a new and improved lead socket which is as reliable and precise as machined sockets, yet is less complex and less labor intensive to manufacture.

BRIEF SUMMARY OF THE INVENTION

The present invention relates to a new and improved lead socket construction and arrangement for mounting same to a dielectric board. A new method for constructing and mounting the socket is also advantageously provided.

In accordance with the invention, a drawn metallic socket is provided. This socket includes an outwardly extending flange at the upper end thereof, a hollow upper body portion, a hollow lower body portion, and a hollow transition portion integrally connecting the upper and lower body portions.

According to another aspect of the invention, there is provided a socket assembly for integrated circuit leads which comprises a dielectric board, a one piece, drawn metallic socket, and a leaf spring insert. The dielectric board includes spaced apart surfaces having mounting apertures extending therebetween for receiving a plurality of elongated sockets. Each socket includes a radial flange portion abutting one of the dielectric board surfaces; a hollow, axial upper body portion extending from the flange portion through one of the mounting apertures; an axially compressed portion formed into abutting engagement with the other of the dielectric board surfaces; a hollow, axial lower body portion extending from the deformed portion and having at least one alignment surface for aligning the angular orientation of the socket; and, an axial lead receiving passage extending into the socket from the upper body portion. The leaf spring insert includes at least one spring leaf disposed in one of the upper and lower body portions in a preselected orientation relative to the alignment surface. In this manner, an integrated circuit lead is receivable in the lead receiving passage in frictional and electrical engagement with the leaf spring.

In accordance with yet another aspect of the invention, a method of constructing a socket assembly is provided. The method includes drawing a thin walled metal socket and inserting the socket into an aperture in a dielectric board such that the socket flange engages one surface of the dielectric board with the socket transition portion disposed outwardly adjacent the opposite dielectric board surface. An axially compressive force is applied to deform the transition portion radially outward and define a retaining collar. The socket flange and retaining collar thus act against opposite surfaces of the dielectric board.

A principal advantage of the present invention is that it facilitates the manufacture and installation of high quality lead sockets.

Another advantage of the invention resides in the maintenance of precise dimensional tolerances for such sockets.

Yet another advantage of the invention is in the low profile, i.e., relatively short axial length, of the lead sockets.

Still further advantages of the present invention will become apparent to others upon a reading and understanding of the following detailed description of the preferred embodiment.

BRIEF DESCRIPTION OF THE DRAWINGS

The invention may take form in various parts and arrangements of parts or in various steps and arrangements of steps. The drawings are for purposes of illustrating a preferred embodiment only and not for limiting same.

FIG. 1 is a longitudinal cross-section of a socket and leaf spring insert formed in accordance with the present invention;

FIG. 2 is a bottom view of the socket of FIG. 1 taken in the direction of lines 2—2;

FIG. 3 is a top view of the socket of FIG. 1 taken in the direction of lines 3—3;

FIG. 4 is an exploded view illustrating installation of a socket and insert into a dielectric board material in accordance with the present invention; and, FIG. 5 is a cross-sectional view of integrated circuit leads received by sockets and inserts mounted in a dielectric board material.

DETAILED DESCRIPTION OF THE PREFERRED EMBODIMENT

Referring now to the drawings, FIG. 1 shows a drawn socket A having a leaf spring insert B press fit thereinto. Typically, a plurality of the sockets are mounted in some predetermined pattern in a dielectric board material C (FIGS. 4 and 5). The leads of an integrated circuit chip or other electrical component D are thereafter frictionally and electrically received in the sockets (FIG. 5).

With particular reference to FIGS. 1, 2, and 3, the drawn socket A includes a first or upper body portion 10 and a second or lower body portion 12. A deformable, transition portion 14 interconnects the upper and lower body portions. A radially outward projecting flange 16 is formed at the inlet end of the upper body portion for positioning the socket on the dielectric board material C. The upper and lower housing portions and the transition portions are hollow to define an axial, lead receiving passage 18.

The upper body portion 10 includes a thin side wall 20 which defines a portion of the axial lead receiving passage therethrough. In the preferred embodiment, the upper lead receiving passage portion is circular in transverse section. Alternately, the lead receiving passage may have other transverse cross-sections as is appropriate for the intended application. The exterior of the upper body portion side wall is also circular in cross-section such that the side wall has a uniform thickness.

With reference to FIGS. 1 and 2, the lower body portion includes a thin side wall 22 which also defines a portion of the lead receiving passage therein. The lower body portion 12 has at least one axially extending flat side or other alignment means for aligning or orienting the socket. In the preferred embodiment, the lower lead receiving passage portion is substantially rectangular, preferably square, in transverse cross-section as is the lower body portion side wall exterior surface. The lower body portion includes a bottom wall 24 which closes the lower end of the axial passage. Alternately, the lower body portion side wall may be comprised of other transverse cross-sections as are appropriate to an intended application.

The deformable transition portion 14 includes a thin transition side wall 26 which flows smoothly between the upper and lower body portion side walls 20,22. The transition side wall is sufficiently thin that it is readily deformable in a manner and for reasons to be described. Specifically, the transition side wall is adapted to buckle outwardly under an axial compressive force to form a retaining collar. Preferably, the transition side wall is of substantially the same wall thickness as the upper and lower body portion side walls.

The flange portion 16 has a generally planar lower surface 28 for abutting one surface of the dielectric board material C. A beveled surface 30 provides a sloping entranceway into the axial lead receiving passage. In the preferred embodiment, the beveled surface is at an angle of approximately 30° relative to the longitudinal axis of the socket A.

With particular reference to FIGS. 1 and 3, the leaf spring insert B includes an annular upper supporting section 40 and a plurality of spring leaves 42, 44, 46, and 48 depending therefrom. The spring leaves are biased inwardly and meet at their distal or free ends in touching engagement. Preferably, the interior surface of at least the free ends of the spring leaves are circumferentially flattened to provide greater electrical contact with rectangular or square leads. Further, the spring leaves each have a short axial section adjacent the free end thereof to increase the axial length of surface area which contacts the received leads. The insert defines a beveled surface 50 adjacent the lead receiving end disposed in alignment with the socket beveled surface 30. The insert is friction fit within the upper body housing 10 with the four spring leaves each being in alignment with a respective one of the flat sides of the lower body portion 12. In this manner, the angular position or orientation of the insert spring leaves and the lower body portion alignment surface are advantageously coordinated.

According to the invention, the socket A is formed by drawing techniques from any drawable metal having appropriate physical properties suitable for use in this environment. An alloy of copper is, however, generally preferred. A blank of the metal is drawn into the desired socket conformation through use of a suitable draw die to have predetermined dimensional characteristics. In drawing, the metal blank is caused to flow between the male and female portions of the die for assuming a desired shape which is defined between the die portions as they are brought into close spaced cooperation with each other. Metal drawing techniques are known in the art and do not, in and of themselves, comprise a part of the present invention. Drawing enables the socket to be shaped with great precision in both its interior and exterior cross-section and with thin side walls. Once the socket has been formed, it may be desirable to plate at least the exterior of lower body portion 12 to enhance its electrical conductivity. Typically, tin or soft gold plating is employed.

The insert B may also be drawn or may be otherwise formed by conventional metal working techniques. The spring leaves may be separately worked to a conformation compatible with the associated socket.

With particular reference to FIG. 4, the insert is press fit into the interior of the socket upper body portion with spring leaves 42,44,46 and 48 in alignment with the exterior flat surfaces of the lower socket body portion. The socket may then be inserted through a mounting aperture 60 which extends between opposed faces 62,64 in the dielectric board material C. Flange lower surface 28 is placed in engagement with surface 62 and the socket transition portion 14 is disposed outwardly adjacent surface 64. If necessary, the socket is rotated to bring the lower body portion alignment surface into a preselected alignment or orientation.

While the flange 16 is constrained in tight frictional engagement with the dielectric material, a die 66 is placed over and receives the socket lower body portion 12 so that the die forward end engages the socket transition portion 14. The die is then caused to exert an axially compressive pressure on the transition portion in the direction of arrow a for causing the transition portion to be axially compressed. Such compression deforms the transition portion into an outward extending retaining collar (FIG. 5) which engages the dielectric body surface 64. In this manner, the socket is mechanically affixed in a preselected orientation to the dielectric body. The die 66 may comprise a length of tubing or the like or may comprise a special die having an internal passage compatible with and only slightly larger than the exterior of the lower body portion 12.

With reference to FIG. 5, the electrical component D has a body 70 which houses an integrated circuit such as a PROM or other electrical component. A plurality of leads 72 extend outwardly of and depend from the sides of the body 70. The leads have tapered portions 74 disposed at the same angle relative to a longitudinal axis as the socket and insert beveled surfaces 30,50. This provides a surface area for electrical contact between the leads and the socket. Further, as the leads are advanced into associated sockets, the leads which commonly have a rectangular cross-section urge the spring leaves of the inserts apart. The sockets and inserts are oriented such that the inner faces of each leaf are substantially parallel with and engage one of the sides of the associated rectangular cross-sectioned lead. The free end of the leads advance through the axially compressed transition portions or collars 14 and into the rectangular cross-sectioned lower body portion 12. Because the leads 72 are commonly manufactured with standardized lengths, the hollow interior passage through the transition portion and lower body portion enable the sockets to receive a lead whose length is commensurate with the length of the socket. This reduces the length or profile of the socket relative to prior art sockets in which the lower body portion was solid and unable to receive the end of the lead. Moreover, the lower body portion passage may be adapted to receive a second spring insert such as a two leaf insert for further improving the frictional and electrical interconnection between the socket and the leads.

The invention has been described with reference to the preferred embodiment. Obviously, modifications and alterations will occur to others upon a reading and understanding of the preceding detailed description of the preferred embodiment. It is intended that the invention be construed as including all such alterations and modifications insofar as they come within the scope of the appended claims or the equivalents thereof.

Having thus described the invention, it is now claimed:

1. A socket assembly for integrated circuit leads comprising:

(a) a dielectric board defining opposed one and other surfaces and having apertures extending therebetween;

(b) a longitudinally elongated one piece, drawn metallic socket including:

(i) a hollow, upper body portion which is generally circular in interior and exterior transverse cross-section extending through one of the body apertures;

(ii) a flange portion extending radially outward from the upper body portion and disposed in an abutting relationship with one of the dielectric board surfaces;

(iii) a deformed portion which is deformed by axial compression into abutting engagement with the dielectric board other surface such that the flange portion and the axially compressed portion interact to secure the socket to the dielectric board;

(iv) a hollow, lower body portion which is generally rectangular in interior and exterior transverse cross-section to define four generally planar longitudinally elongated interior and exterior surface portions and is coaxial with the upper body portion, at least one of the four exterior lower body portion planar surface portions defining an alignment surface for aligning the angular orientation of the socket relative to the one aperture;

(v) an elongated lead receiving passage defined by the interior of the upper and lower body portions; and, (c) a leaf spring insert including four integrally connected spring leaves disposed in the upper body portion, each of the four spring leaves being disposed in alignment with one of the four interior lower body planar surface portions, whereby a rectangular cross-sectioned integrated circuit lead is receivable in the axial lead receiving passage in frictional and electrical engagement with the spring leaves.

2. The assembly as set forth in claim 1 wherein the lower body portion has a generally square exterior in transverse cross-section.

3. A drawn metallic socket comprising:

a hollow, upper body portion defining an axial passage therethrough;

an integrally formed flange portion extending radially outward of the upper body portion adapted for frictional contact with an upper surface of a dielectric support;

a hollow, lower body portion extending axially of the upper body portion and defining an axial passage therein, the lower body portion being longitudinally elongated and smaller in transverse cross-section than the upper body portion, the lower body portion defining at least one generally planar longitudinally elongated interior and exterior surface portion defining an alignment surface for aligning the angular orientation of the socket about the socket longitudinal axis;

an integral transition portion interposed between and integrally formed with the upper and lower body portions, the transition portion having the same general transverse cross-section as the upper body portion at its upper end and generally the same transverse cross-section as the lower body portion at its lower end, the transition portion having an axial passage therethrough in alignment with the upper and lower body portion axial passages such that the axial passages are adapted to receive a linear lead, the transition portion being sufficiently thin walled that it is adapted to be deformed under axially compressive pressure into an outwardly extending collar; and, an insert press fit into the upper body portion axial passage above the transition portion, the insert having a plurality of spring leaves extending into the upper body portion axial passage to improve frictional and electrical engagement with a received lead, one of the spring leaves being disposed in alignment with the interior generally planar surface, whereby disposing the exterior generally planar surface in a preselected angular orientation aligns the spring leaves with the received lead.

4. A method of constructing a socket assembly comprising the steps of:

drawing a thin walled metallic socket to include an upper body portion having first interior and exterior transverse cross-sections, a lower body portion having generally rectangular second interior and exterior transverse cross-sections with the second transverse cross-sections being smaller than the first transverse cross-sections, a transition portion integrally interconnecting the upper and lower body portions with the transition portion having the first transverse cross-section at its upper end and the rectangular, second cross-section at its lower end, a flange extending radially outward from the upper body portion, and an axial passage extending through the upper body portion, the transition portion, and into the lower body portion;

press fitting a leaf spring insert having at least a pair of spring leaves into the upper body portion such that the spring leaves are aligned with opposite sides of the rectangular lower body portion;

inserting the socket into an aperture in a dielectric board with the lower body portion rectangular exterior cross-section disposed in a preselected angular orientation such that the flange engages a one surface of the board and the transition portion is disposed outwardly adjacent an opposite surface of the board; and, applying an axial compressive force between the flange and the transition portion in such a manner that the transition portion is deformed radially outward forming a retaining collar while maintaining the axial passage therethrough, the dielectric board being captured between the flange and the retaining collar.

5. The method as set forth in claim 4 wherein in the drawing step, the socket lower body portion is drawn with a generally square transverse cross-section.

6. The method as set forth in claim 4 further including inserting a lead from an electrical component into the socket passage such that the lead cams the spring leaves apart and the lead extends through the upper body portion, the transition portion, and into the lower body portion.

* * * * *